US006021916A

United States Patent [19]

Stolzman

[11] Patent Number: 6,021,916

[45] Date of Patent: Feb. 8, 2000

[54] PLASTIC PALLET BIN

[76] Inventor: Michael D. Stolzman, c/o International Precision Components, 28468 N. Ballard Dr., Lake Forest, Ill. 60045

[21] Appl. No.: 09/186,737

[22] Filed: Nov. 5, 1998

[51] Int. Cl.[7] ..... B65D 6/38

[52] U.S. Cl. ..... 220/675; 220/4.33; 220/673; 206/600

[58] Field of Search ..... 220/4.28, 4.29, 220/4.33, 6, 7, 645, 673, 675; 206/600, 386

[56] References Cited

U.S. PATENT DOCUMENTS

| | | | |
|---|---|---|---|
| 3,618,805 | 11/1971 | Meller | 220/6 |
| 3,966,285 | 6/1976 | Porch et al. | 220/4.33 |
| 4,050,604 | 9/1977 | Flanders . | |
| 4,456,142 | 6/1984 | Burling | 6/503 |
| 4,673,087 | 6/1987 | Webb | 206/600 |
| 4,700,862 | 10/1987 | Carter et al. | 220/6 |
| 4,809,851 | 3/1989 | Oestreich, Jr. et al. . | |
| 4,828,132 | 5/1989 | Francis, Jr. et al. | 220/6 |
| 5,031,776 | 7/1991 | Morgan, IV | 206/600 |
| 5,056,666 | 10/1991 | Janssens . | |
| 5,109,985 | 5/1992 | Rose . | |
| 5,251,753 | 10/1993 | Pigott et al. . | |
| 5,356,014 | 10/1994 | Berner . | |
| 5,441,154 | 8/1995 | Youell, III . | |
| 5,555,980 | 9/1996 | Johnston et al. . | |
| 5,558,241 | 9/1996 | Huffstutler, Jr. et al. . | |
| 5,558,242 | 9/1996 | Kuan . | |
| 5,564,599 | 10/1996 | Barber et al. . | |
| 5,566,849 | 10/1996 | Goehner . | |
| 5,609,111 | 3/1997 | Hasegawa et al. . | |

FOREIGN PATENT DOCUMENTS

| | | |
|---|---|---|
| 2086351A | 5/1982 | United Kingdom . |

*Primary Examiner*—Stephen Castellano
*Attorney, Agent, or Firm*—Wood, Phillips, VanSanten, Clark & Mortimer

[57] ABSTRACT

A pallet bin comprises a generally rectangular base having a generally planar support surface. A pair of opposite side panels and a pair of opposite end panels between the side panels each stand vertically at one side of the rectangular base to define a parallelepiped interior space. Each of the side panels and end panels comprises a planar outer wall and a planar inner wall and an internal rib structure connecting the outer wall spaced from the inner wall to define hollow portions therebetween.

24 Claims, 8 Drawing Sheets

PLASTIC PALLET BIN

FIELD OF THE INVENTION

The present invention is directed toward the shipment of bulk goods and, more particularly, to a plastic pallet bin for storing and shipping goods.

BACKGROUND OF THE INVENTION

A pallet bin is used to store and ship goods of liquid, solid, and granular materials. A typical pallet bin is constructed of plywood panels with a built-in pallet base. The pallet bin is generally of all wood construction including a wood bottom panel screwed or nailed to a conventional wooden pallet. Plywood side and end panels are held together using corner angle and placed atop the bottom panel and are secured using retaining brackets. A plywood top can be placed atop the side and end panels. A plastic liner is placed inside the bin to prevent the product from coming into direct contact with the wood panels. Such a bin typically has a three hundred gallon capacity.

In use, a large plastic aseptic bag is placed in the bin and sealed. The bag may include a food product such as a puree from fruits or vegetables. The bin acts as a skeleton to transport the processed food. When the bag is empty it is thrown away. Typically, the pallet bins are collapsible as by breaking down the top cover and the side and end walls and stacking them on the bottom panel. The bin can then be shipped back to the supplier. Such use typically also requires use of banding for supporting the wood panels. Without the banding, the wood panels might not hold the product. Also, wood splinters and improperly placed nails can destroy the bags. Moreover, after repeated nailing, the wood panels become weaker and therefore must be disposed of. This contributes to the escalating problem of waste disposal.

More recently, pallet bins have been constructed principally of plastic. These bins typically utilize interlocking structure for holding the various components together. However, due to the need for strength, while limiting weight, plastic pallet bins typically incorporate structures having numerous voids. However, dirt, insects and rodents could gather in such voids. This could render the products undesirable for use in the food industry.

The present invention is directed to overcoming one or more of the problems discussed above in a novel and simple manner.

SUMMARY OF THE INVENTION

In accordance with the invention, a pallet bin uses generally smooth planar surfaces.

Broadly, there is disclosed herein a pallet bin comprising a generally rectangular base having a generally planar support surface. A pair of opposite side panels and a pair of opposite end panels between the side panels each stand vertically at one side of the rectangular base to define a parallelepiped interior space. Each of the side panels and end panels comprises a planar outer wall and a planar inner wall and an internal rib structure connecting the outer wall spaced from the inner wall to define hollow portions therebetween.

It is a feature of the invention that the planar support surface and the inner surface of each inner wall comprises a generally smooth planar surface.

It is another feature of the invention that the rib structure of each panel has a continuous peripheral side edge to provide a sealed panel. The internal rib structure is in the configuration of a mesh rib.

It is another feature of the invention that each panel includes a plurality of hollow internal wells in a checkerboard configuration defining integral ribs therebetween to reduce weight of the pallet bin while maintaining stiffness of the pallet.

It is another feature of the invention that each side panel includes plural vertically spaced openings at opposite sides adjacent the end panels and further comprising corner braces fastened to each side panel at the openings to support the end panels.

It is an additional feature of the invention that the base has a peripheral channel opening upwardly from the bottom wall, the peripheral channel receiving the four panels.

It is yet another feature of the invention to provide a cover receivable along a top edge of each of the panels. The cover comprises an outer wall and a planar inner wall and an internal rib structure connecting the outer wall spaced from the inner wall to define hollow portions therebetween.

It is yet another feature of the invention that the base comprises a planar upper wall and a formed bottom portion including plural integral downwardly extending feet, and an internal rib structure connecting the upper wall spaced from the bottom portion to define hollow portions therebetween.

It is still another feature of the invention that the cover has plural upwardly extending supports for supporting the base of another of said pallet bins.

In accordance with one aspect of the invention the base, the panels and cover are of molded plastic construction.

Further features and advantages of the invention will be readily apparent from the specification and from the drawings.

DETAILED DESCRIPTION OF THE INVENTION

Figure 1:
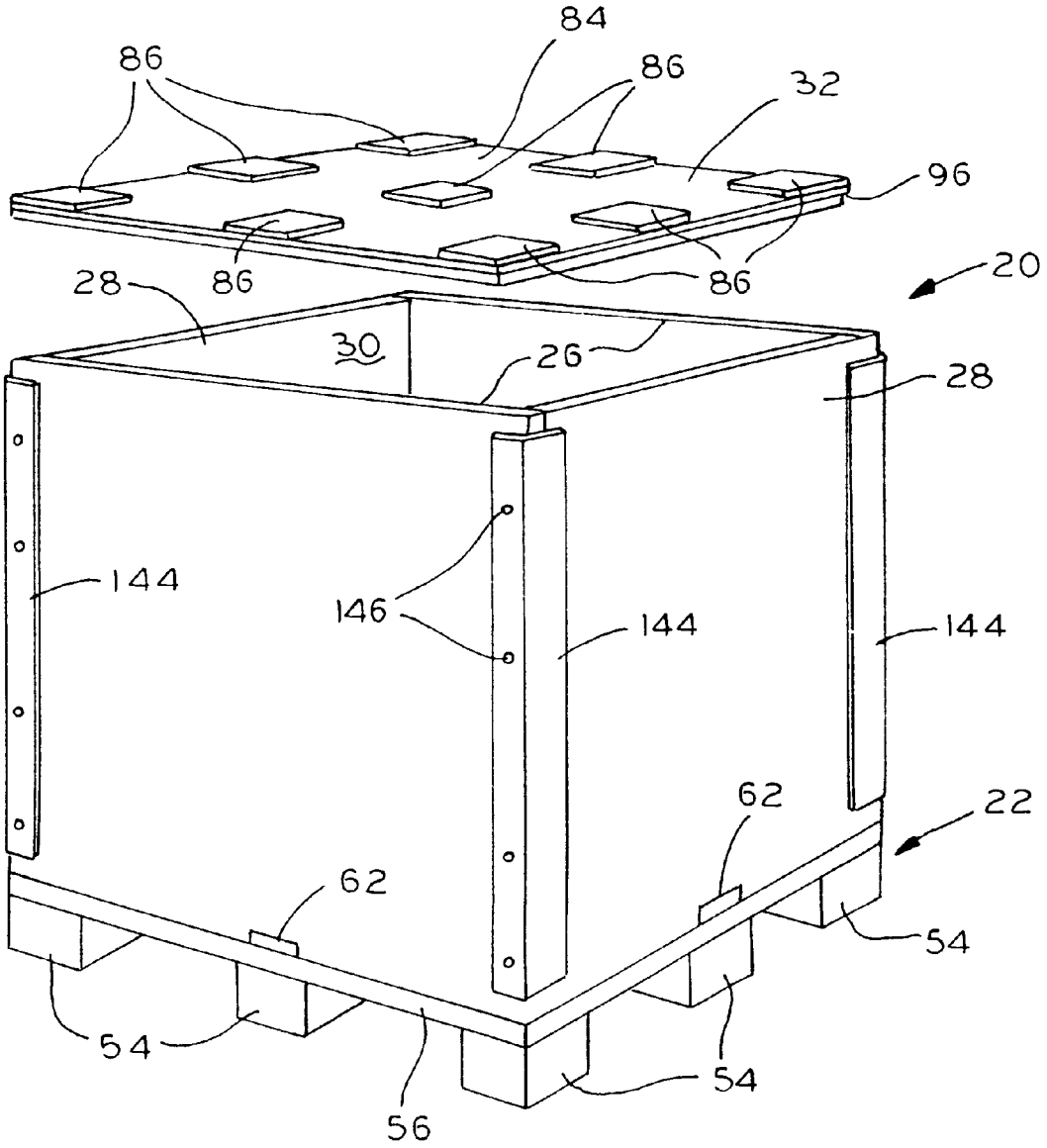
FIG. 1 is a perspective view of a pallet bin according to the invention.
Figure 2:
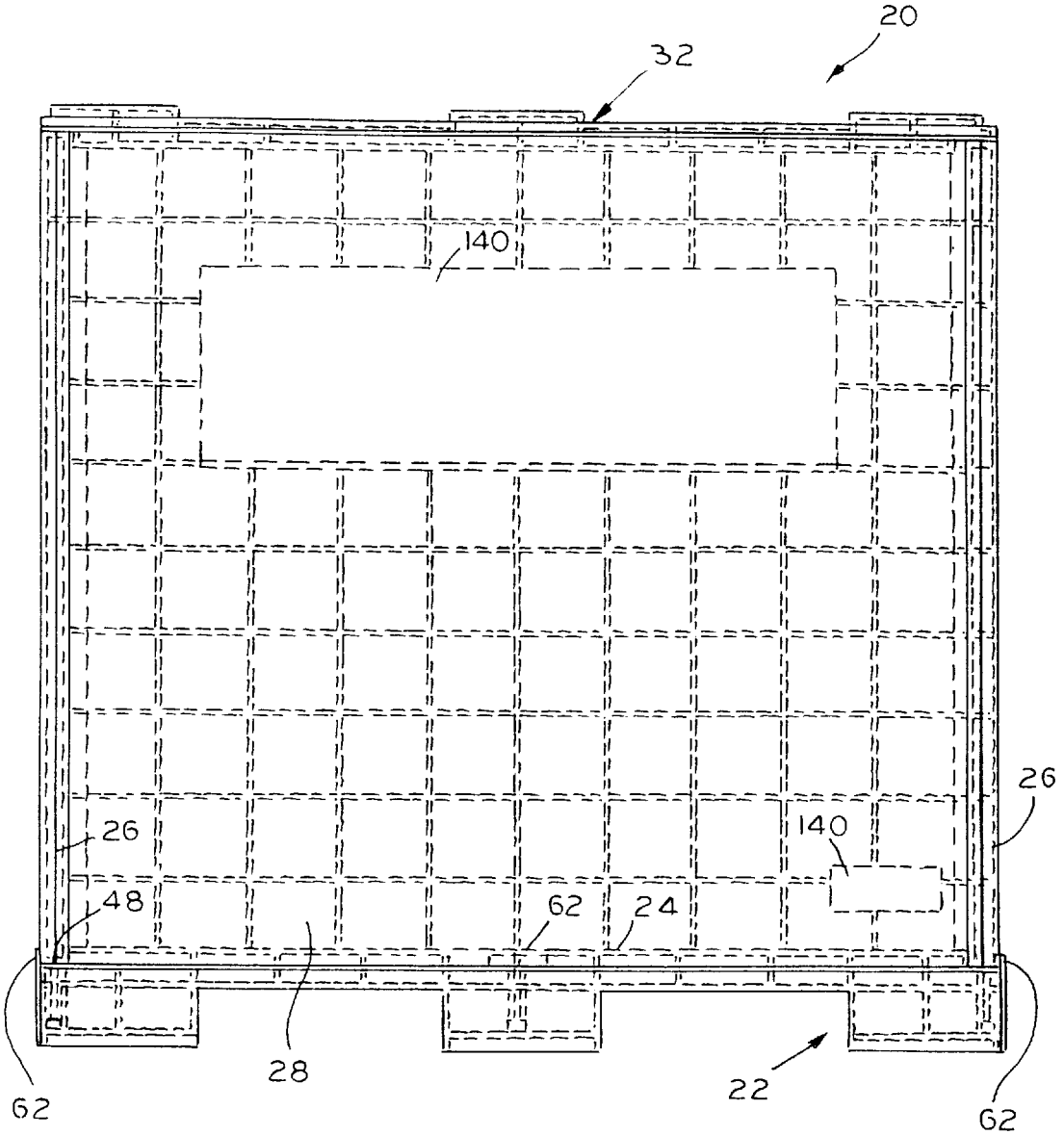
FIG. 2 is a front elevation view of the pallet bin of FIG. 1 with corner braces removed.
Figure 3:
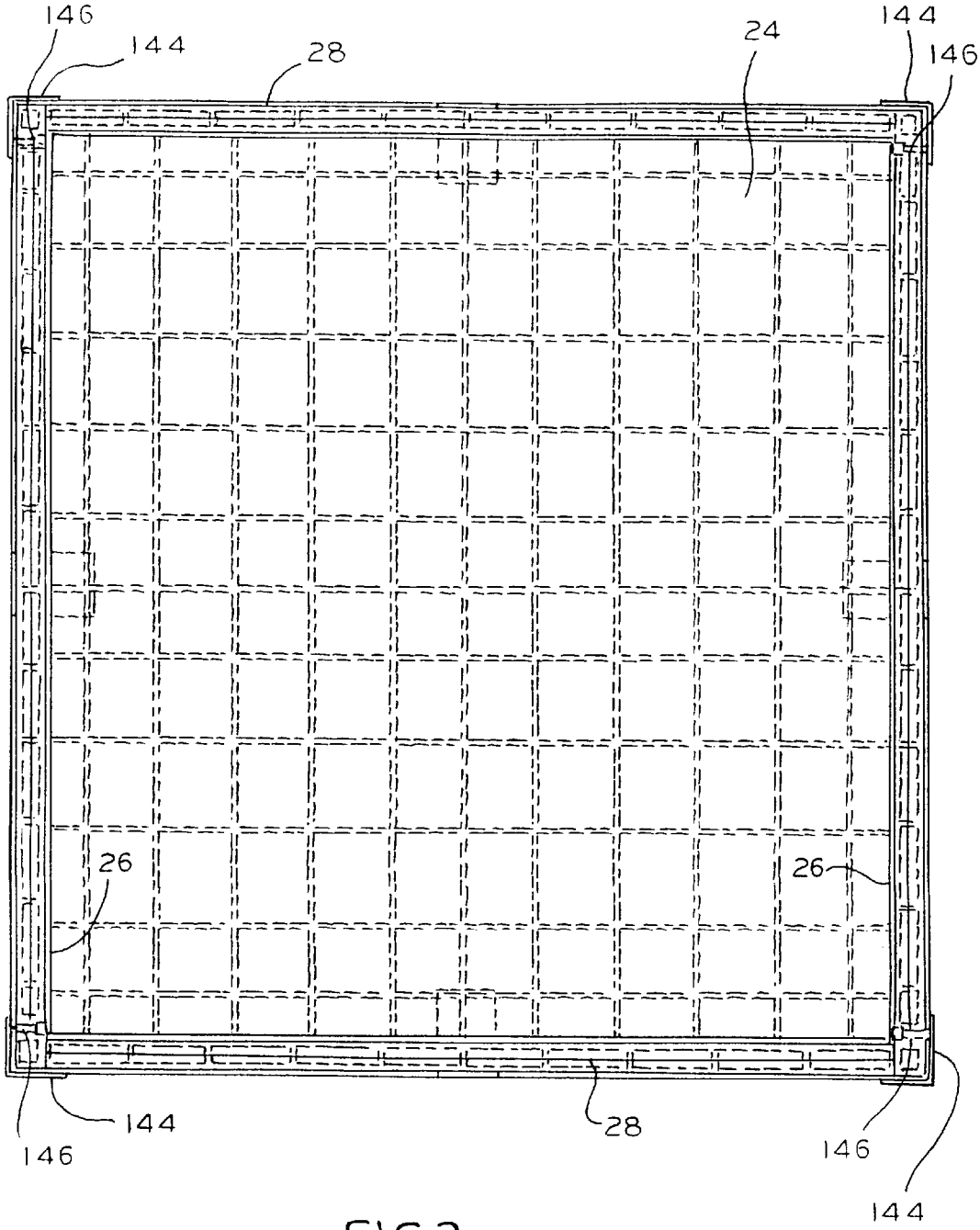
FIG. 3 is a plan view of the bin of FIG. 1 with the cover removed.

Referring to FIGS. 1–3, a pallet bin 20 according to the invention is illustrated. The pallet bin 20 is particularly adapted for bulk shipment of goods such as liquid, solid and granular materials, and is approximately 44"W by 48"L by 44"H to provide approximately a three hundred gallon capacity. As is apparent, the pallet bin 20 could be of smaller size, as necessary or desired, according to the particular shipping and storage requirement.

FIGS. 2–10 of the drawing illustrate various views of the pallet bin 20 or its component parts. Each of these figures illustrates the outline of the particular part(s) in solid line and includes phantom or dashed lines to illustrate internal structure of the various component parts, as the internal structure is a significant aspect of the invention as will be apparent.

The bin 20 includes a generally rectangular base 22 having a generally planar support surface 24. The bin includes a pair of opposite side panels 26 and a pair of opposite end panels 28. The end panels 28 are disposed between the side panels 26. Each panel 26 and 28 stands vertically on one side of the rectangular base 22 to define a parallelepiped interior space 30. In use, the interior space 30 is filled with a plastic liner or bag (not shown) which contains the material to be stored and/or shipped. A top cover 32 is placed atop the panels 26 and 28 to close the interior space 30. In accordance with the invention, the base 22, the panels 26 and 28, and the top cover 32 are each of one piece plastic construction, such as high density polyethylene. Particularly, each is initially molded into two separate parts each having various walls and ribs, as described, all approximately one quarter inch thick throughout. The two parts are then hot plate welded together to form the individual structural elements, as described more particularly below.

Figure 4:
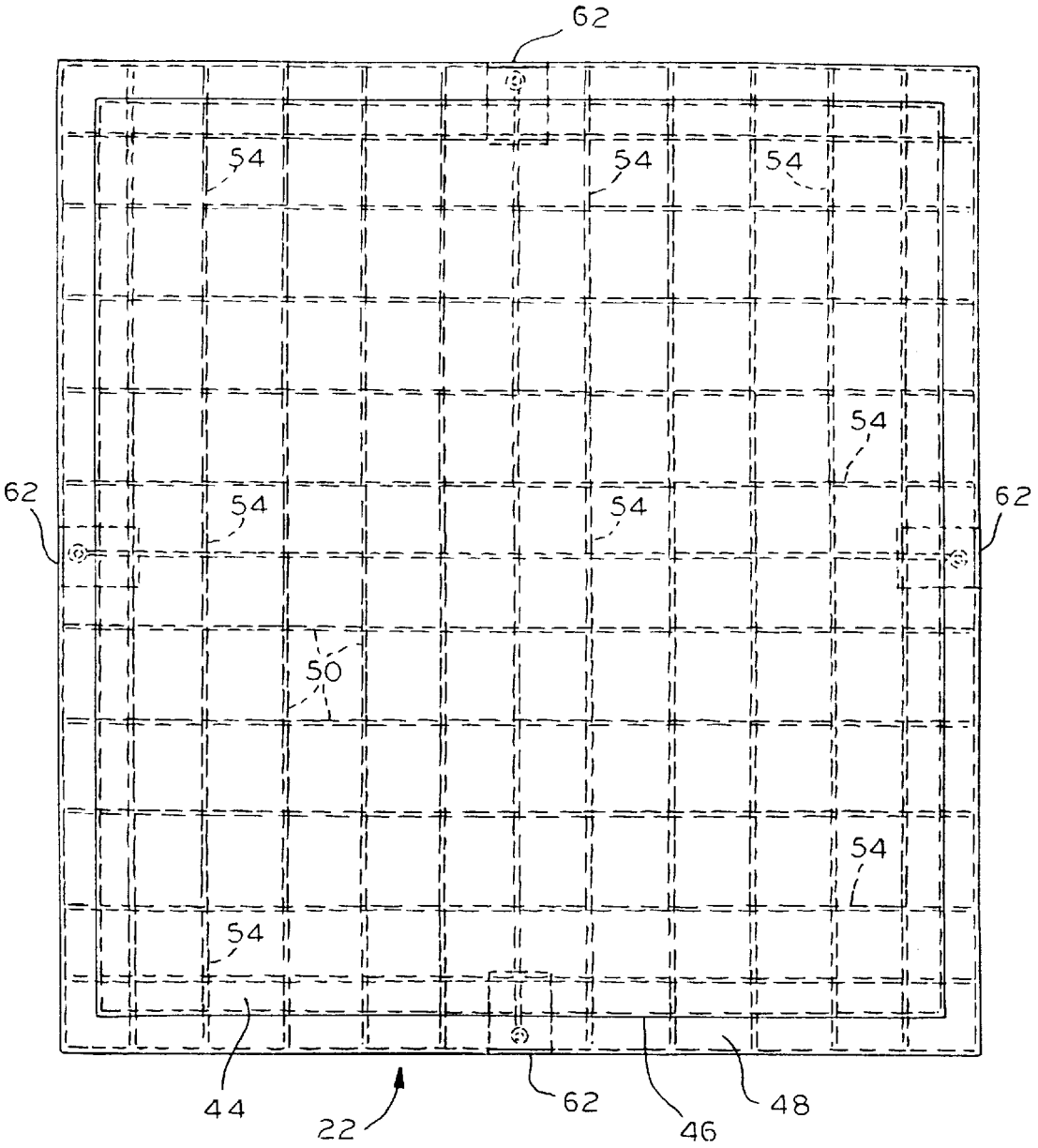
FIG. 4 is a plan view of a base of the pallet bin of FIG. 1.
Figure 5:
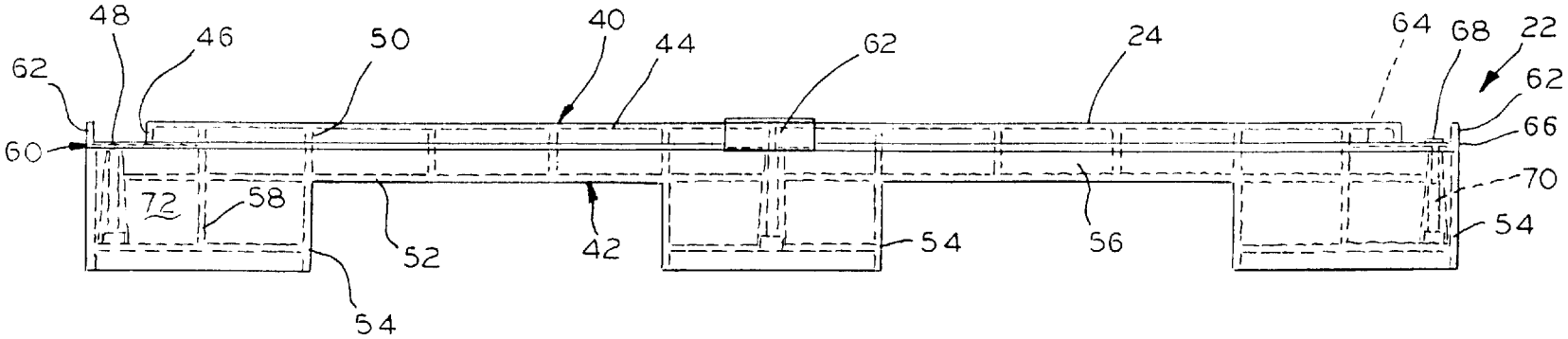
FIG. 5 is a front elevation view of the base of FIG. 4.

Referring to FIGS. 4 and 5, the base 22 is illustrated. The base comprises a formed upper portion 40 and a formed bottom portion 42. The upper portion 40 is of molded plastic construction and includes a planar upper wall 44 which defines the planar support surface 24. The planar upper wall 44 is generally rectangular and includes a downwardly turned perimeter edge 46 connecting an outwardly turned planar peripheral flange 48. The flange 48 defines a peripheral channel opening upwardly from adjacent the bottom wall 44. The channel 48 receives the panels 26 and 28, as shown in FIG. 2. Extending downwardly from the upper wall 44 inside the peripheral side edge 46 is an integral rib structure 50 in the configuration of a mesh rib, as illustrated in phantom in FIG. 4.

The bottom portion 42 is formed to include a bottom wall 52 having integral downwardly extending feet 54. A foot 54 is provided at each corner and centrally between each pair of corners for a total of nine, as illustrated in FIG. 5. Particularly, one is provided at each corner, one centrally located at each side edge between corners, and one located in the center of the base 22. The feet 54 are adapted to rest on a support surface such as a floor, a warehouse shelf, or another pallet bin, as described more particularly below. The bottom wall 52 is surrounded by an upwardly turned peripheral wall 56 which also surrounds each of the feet 54. Extending upwardly from the bottom wall 52 and internally of the feet 54, and surrounded by the wall 56, is an internal rib structure 58 also in the configuration of a mesh rib. The rib structure 58 is adapted to be aligned with the upper portion rib structure 50 when the upper portion 40 is placed atop the bottom portion 42. The upper portion 40 and bottom portion 42 are hot plate welded together along a weld line 60. Particularly, a hot plate is placed between the two portions to melt plastic on both sides. The two melted surfaces are then placed together under pressure. Upon cooling, the base 22 becomes an integral one piece unit. Indeed, the integrity of the plastic is stronger at the weld portion than elsewhere.

Four L-brackets 62 are secured to the base 22. Each L-bracket 62 has a horizontal portion 64 and vertical portion 66. The horizontal portion 64 may be secured to the base 22 as by being integrally molded or welded therein, or may use a fastener such as a fastener 68 threaded into an opening 70 provided within each foot 54 for receiving the fastener 68. Each L-bracket 62 is positioned centrally of each side portion of the flange 48 with the vertical portion 66 supporting the panels 26 and 28 in the channel, as shown in FIGS. 1 and 2.

With the base so constructed, the upper mesh rib 50 and bottom mesh rib 58 are welded together to provide an I-beam structure to strengthen the base 22. This results in a plurality of hollow internal wells 72 in a checkerboard configuration which reduces weight of the base 22 while maintaining stiffness and strength.

Figure 7:
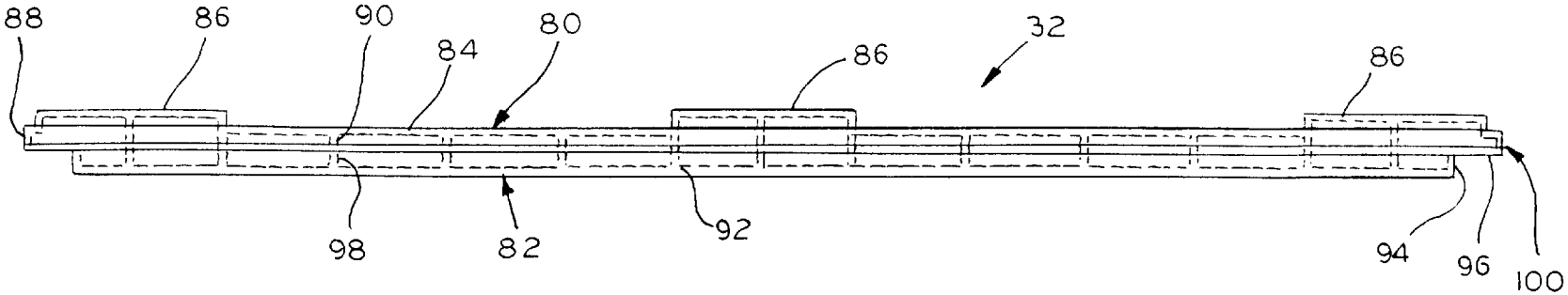
FIG. 7 is a side elevation view of the cover of FIG. 6.
Figure 6:
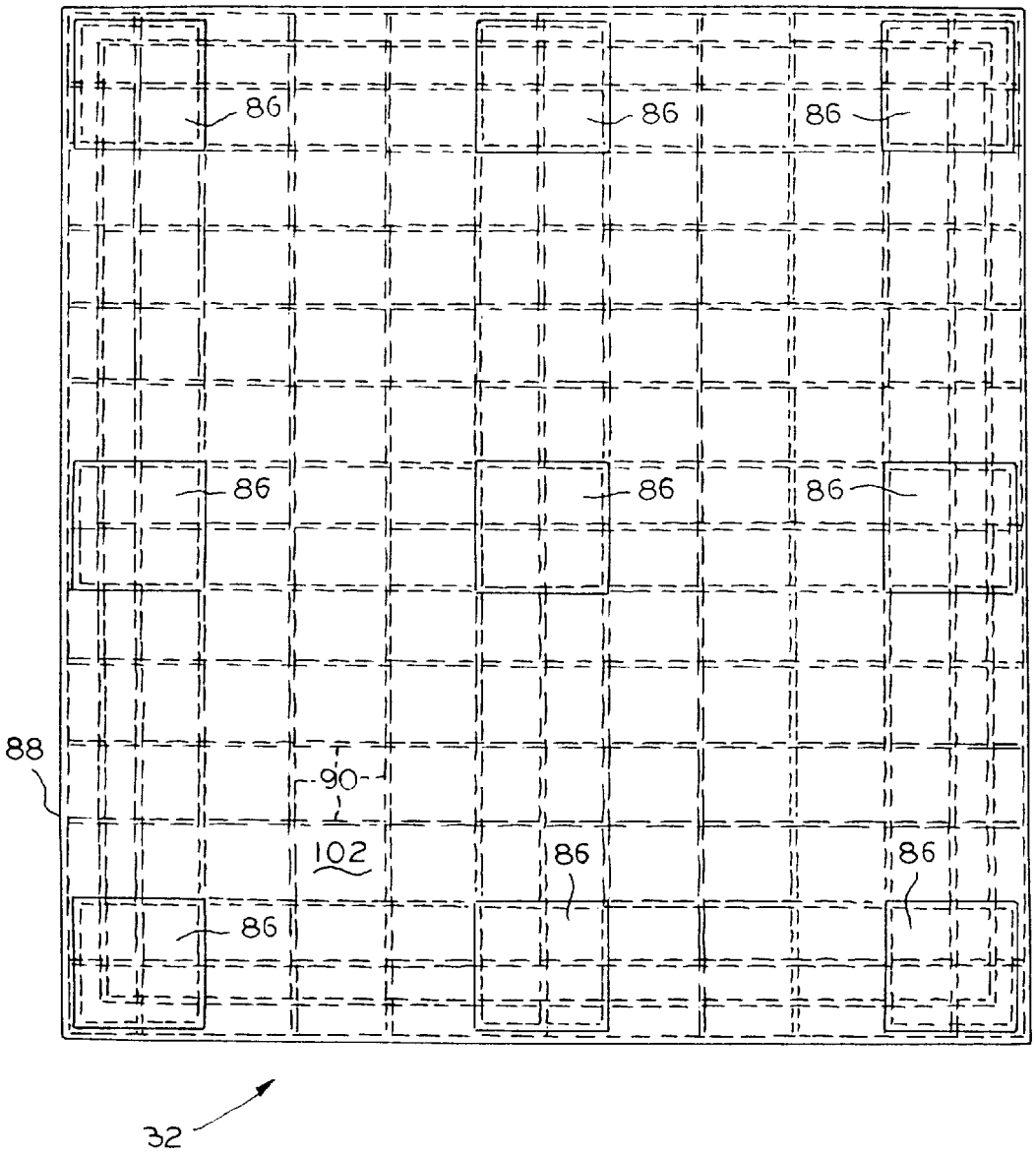
FIG. 6 is a plan view of a cover of the pallet bin of FIG. 1.

Referring to FIGS. 6 and 7, the top cover 32 is illustrated. The top cover 32 is formed using similar techniques to the base 22. Particularly, the top cover 32 includes an upper portion 80 and a lower portion 82. The upper portion 80 comprises a generally planar wall 84 having nine upwardly extending rectangular supports 86 positioned similarly to the feet 54. There is an upper support 86 at each corner, along side edges between each corner, and in a center of the cover 32. The supports 86 are positioned so that when the top cover 32 is placed atop the pallet bin 20, another pallet bin can be stacked on top with the feet 54 of the upper pallet bin resting on the supports 86. A peripheral side edge wall 88 extends downwardly from the planar wall 80. An internal rib structure 90 in the configuration of a mesh rib extends downwardly from the upper wall 84 and the supports 86 inside the peripheral edge wall 88.

The lower portion 82 includes a planar inner wall 92 connected to a peripheral upwardly extending side edge 94 that is in turn connected to an outwardly extending peripheral flange 96. An internal rib structure 98 in the configuration of a mesh rib extends upwardly from the inner wall 92 inside the peripheral side edge 94. As with the base, the rib structures 90 and 98 are adapted to be aligned with one another with the upper portion 80 placed atop the lower portion 82 as shown. The two parts are then hot plate welded together along a weld line 100 to provide an integral one-piece top cover 32. The integrally welded rib structures 90 and 98 again provide an I-beam-like construction with hollow internal wells 102 in a checkerboard configuration therebetween reducing weight of the top cover 32 while maintaining stiffness and strength. The rectangular size of the inner wall 88 corresponds to that of the base upper wall 44 so that the side edge 94 is received within the interior space 30 with the flange 96 resting atop the panels 26 and 28 to close the space.

Figure 8:
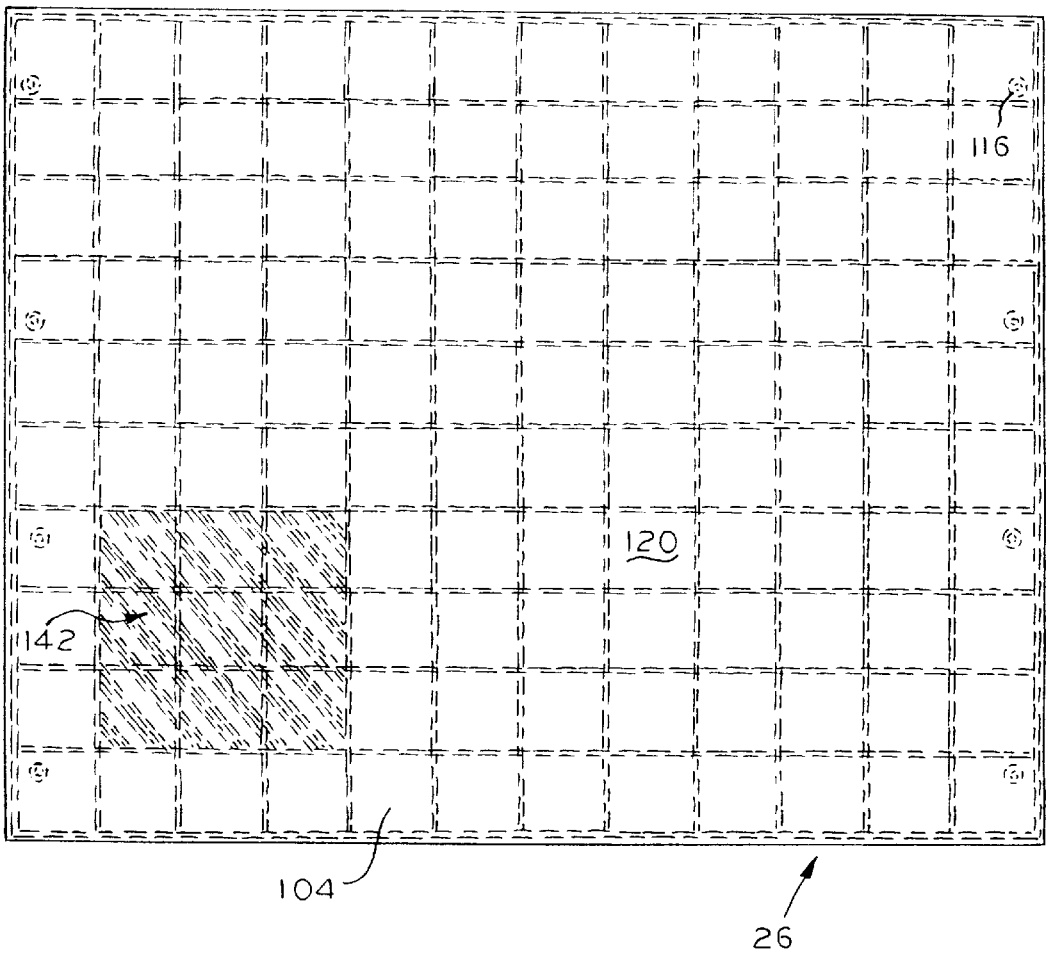
FIG. 8 is an elevation view of a side panel of the pallet bin of FIG. 1.
Figure 9:
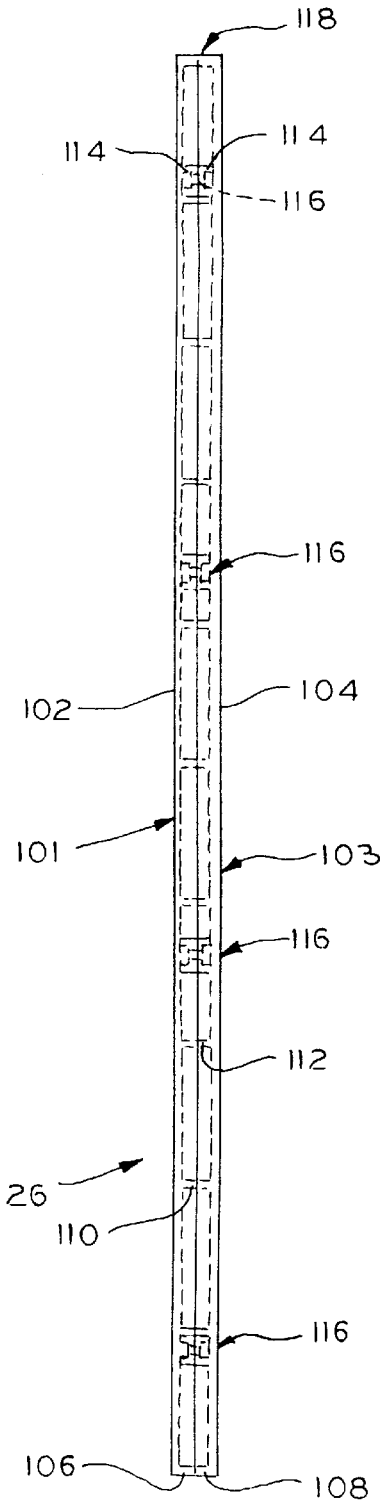
FIG. 9 is a side elevation view of the side panel of FIG. 8.

Referring to FIGS. 8 and 9, one of the side panels 26 is illustrated. While only one is shown, the opposite side panel 26 is of identical construction.

The side panel 26 includes a an inner portion 101 having planar inner wall 102 and an outer portion 103 having a planar outer wall 104. The planar inner wall 102 is connected to an outwardly extending peripheral edge wall 106. Similarly, the outer wall 104 is connected to an inwardly extending peripheral edge wall 108. Extending outwardly from the inner wall 102 is an internal rib structure 110 in the configuration of a mesh rib inside the peripheral edge wall 106. Similarly, extending inwardly from the outer wall 104 is an internal mesh rib 112. Along each vertical edge four vertically spaced bosses 114 extend from each wall 102 or 104 toward the other to form through openings 116. As with the base 22 and cover 32, the inner portion 101 and outer portion 103 are welded together along a weld line 118 using hot mold welding. This results in an I-beam structure with a plurality of hollow internal wells 120 in a checkerboard configuration to reduce weight of the side panel 26 while maintaining stiffness and strength.

Figure 10:
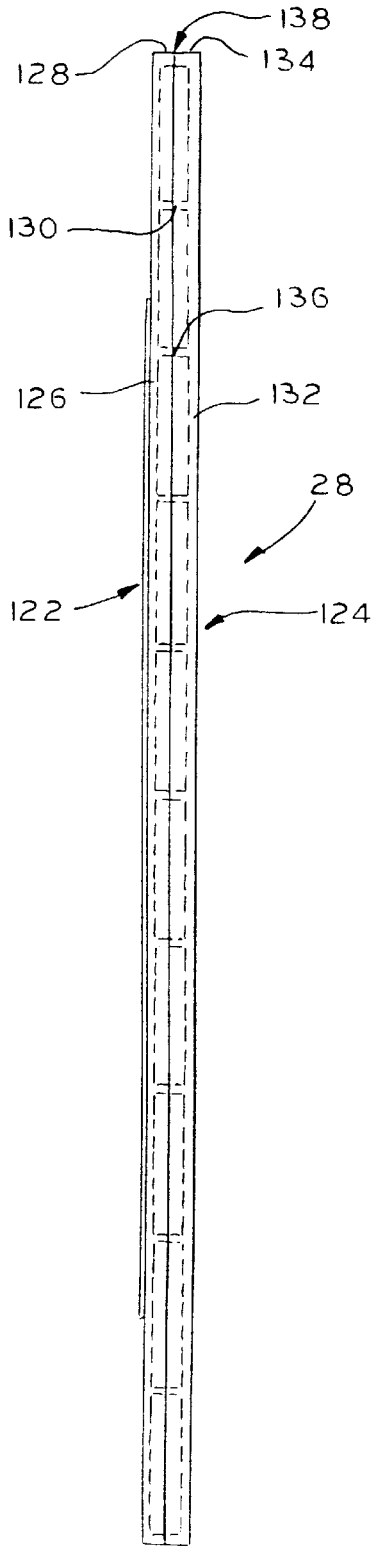
FIG. 10 is a side elevation view of an end panel of the pallet bin of FIG. 1.

The end panels 28 are generally similar to the side panels 26, albeit of smaller length. Likewise, the end panels 28 do not include the through openings 116. As illustrated in FIG. 10, the end panels 28 include an inner portion 122 and an outer portion 124. The inner portion 122 includes a planar inner wall 126 connected to a peripheral edge wall 128 and having an internal mesh rib structure 130. Similarly, the outer portion 124 includes a planar outer wall 132 connected to a peripheral edge wall 134 and having an internal mesh rib structure 136. The inner portion 122 and outer portion 124 are hot plate welded together along a weld line 138.

In accordance with the invention, the base upper surface 24 and the panel inner walls 102 and 126 comprise generally smooth planar surfaces. As illustrated in FIG. 2, the outer surface of the end panel 28 may be smooth or have a textured surface. If a textured surface is included, then a generally rectangular polished areas 140 may be provided for adding a product label. Similarly, the side panel 26 may include a polished area 142, see FIG. 8, for labeling or the like.

To support the end panels 28 relative to the side panels 26, four heavy gauge steel L-brackets 144 are used, one at each corner. Each L-bracket 144 extends less than the vertical height of the panels 26 and 28. Each bracket 144 is secured using threaded fasteners 146 extending through the openings 116 in the side panels 26.

When not used, the panels 26 and 28 and the top cover 32 can be stacked atop the base 22 for storage or shipment back to a supplier. When ready to be used, the side panels 26 are stood vertically at one side of the rectangular base 22 in the channel 48. The end panels 28 are then similarly placed in the channel 48 between the side panels 26. Outward movement of the end panels 28 is restricted by the corner brackets 144. When the top cover 32 is installed, the end panels 28 are prevented from moving inwardly. Moreover, once the interior space 30 is filled, then the contents will also force the end panels 28 outwardly against the corner brackets 144 to maintain the pallet bin 20 in assembled construction. Once assembled, then plural pallet bins 20 can be stacked atop one another with the feet 54 resting on the nesting structures 86, as described.

Thus, in accordance with the invention there is disclosed a plastic pallet bin having planar inner and outer sidewalls having integral rib structures to reduce weight of the pallet bin while maintaining stiffness of the individual panels.

I claim:

1. A pallet bin comprising:

a generally rectangular base having a generally planar support surface;

a pair of opposite side panels and a pair of opposite end panels between the side panels, each panel being of plastic construction and standing vertically at one side of the rectangular base to define a parallelepiped interior space, each of the side panels and end panels comprising a planar outer wall and a planar inner wall and an internal rib structure connecting the outer wall spaced from the inner wall to define hollow portions therebetween, wherein the rib structure of each said panel is surrounded by a continuous peripheral side edge to provide a sealed panel.

2. The pallet bin of claim 1 wherein the planar support surface of the base and the inner surface of each inner wall comprises a generally smooth planar surface.

3. The pallet bin of claim 1 wherein each said internal rib structure is in the configuration of a mesh rib.

4. The pallet bin of claim 1 wherein each side panel includes plural vertically spaced openings at opposite sides adjacent the end panels and further comprising corner braces fastened to each side panel at the openings to support the end panels.

5. The pallet bin of claim 1 wherein said base has a peripheral channel opening upwardly from the bottom wall, the peripheral channel receiving the four panels.

6. The pallet bin of claim 1 further comprising a cover receivable along a top edge of each of the panels.

7. The pallet bin of claim 6 wherein the cover comprises an outer wall and a planar inner wall and an internal rib structure connecting the outer wall spaced from the inner wall to define hollow portions therebetween.

8. A pallet bin comprising:

a generally rectangular base having a generally planar support surface;

a pair of opposite side panels and a pair of opposite end panels between the side panels, each panel standing vertically at one side of the rectangular base to define a parallelepiped interior space, each of the side panels and end panels comprising a planar outer wall and a planar inner wall and an internal rib structure connecting the outer wall spaced from the inner wall to define hollow portions therebetween wherein each said panel includes a plurality of hollow internal wells in a checkerboard configuration defining integral ribs therebetween to reduce weight of the pallet bin while maintaining stiffness of the panels.

9. A plastic pallet bin comprising:

a generally rectangular base having a generally planar support surface;

a pair of opposite side panels and a pair of opposite end panels between the side panels, each panel standing vertically at one side of the rectangular base to define a parallelepiped interior space, each of the side panels and end panels comprising a planar outer wall and a planar inner wall and an internal rib structure connecting the outer wall spaced from the inner wall to define hollow portions therebetween, wherein the rib structure of each said panel is surrounded by a continuous peripheral side edge to provide a sealed panel; and the base and the panels being of molded plastic construction.

10. The plastic pallet bin of claim 9 wherein the planar support surface of the bottom wall and the inner surface of each inner wall comprises a generally smooth planar surface.

11. The plastic pallet bin of claim 9 wherein each said internal rib structure is in the configuration of a mesh rib.

12. The plastic pallet bin of claim 9 wherein each side panel includes plural vertically spaced openings at opposite sides adjacent the end panels and further comprising corner braces fastened to each side panel at the openings to support the end panels.

13. The plastic pallet bin of claim 9 wherein said base has a peripheral channel opening upwardly from adjacent the bottom wall, the peripheral channel receiving the four panels.

14. The plastic pallet bin of claim 9 further comprising a cover receivable along a top edge of each of the panels.

15. The plastic pallet bin of claim 14 wherein the cover comprises an outer wall and a planar inner wall and an internal rib structure connecting the outer wall spaced from the inner wall to define hollow portions therebetween.

16. The plastic pallet bin of claim 15 wherein the cover has plural upwardly extending supports for supporting the base of another of said plastic pallet bins.

17. The plastic pallet bin of claim 9 further wherein the base comprises a planar upper wall and a formed bottom portion including plural integral downwardly extending feet, and an internal rib structure connecting the upper wall spaced from the bottom portion to define hollow portions therebetween.

18. A plastic pallet bin comprising:

a generally rectangular base having a generally planar support surface;

a pair of opposite side panels and a pair of opposite end panels between the side panels, each panel standing vertically at one side of the rectangular base to define a parallelepiped interior space, each of the side panels and end panels comprising a planar outer wall and a planar inner wall and an internal rib structure connecting the outer wall spaced from the inner wall to define hollow portions therebetween; and the base and the panels being of molded plastic construction, wherein each said panel includes a plurality of hollow internal wells in a checkerboard configuration defining integral ribs therebetween to reduce weight of the plastic pallet bin while maintaining stiffness of the panels.

19. A reinforced plastic pallet bin comprising:

a generally rectangular base having a generally planar support surface;

a pair of opposite side panels and a pair of opposite end panels between the side panels, each panel standing vertically at one side of the rectangular base to define a parallelepiped interior space, each of the side panels and end panels comprising a planar outer wall and a planar inner wall and an internal rib structure connecting the outer wall spaced from the inner wall to define hollow portions therebetween, wherein the rib structure of each said panel is surrounded by a continuous peripheral side edge to provide a sealed panel four corner braces, each corner brace being adapted to be secured to the side panels to support the end panels, the base and the panels being of molded plastic construction.

20. The reinforced plastic pallet bin of claim 19 wherein each said internal rib structure is in the configuration of a mesh rib.

21. The reinforced plastic pallet bin of claim 19 wherein said base has a peripheral channel opening upwardly from the bottom wall, the peripheral channel receiving the four panels.

22. The reinforced plastic pallet bin of claim 19 further comprising a cover receivable along a top edge of each of the panels.

23. The reinforced plastic pallet bin of claim 22 wherein the cover comprises an outer wall and a planar inner wall and an internal rib structure connecting the outer wall spaced from the inner wall to define hollow portions therebetween.

24. A reinforced plastic pallet bin comprising:

a generally rectangular base having a generally planar support surface;

a pair of opposite side panels and a pair of opposite end panels between the side panels, each panel standing vertically at one side of the rectangular base to define a parallelepiped interior space, each of the side panels and end panels comprising a planar outer wall and a planar inner wall and an internal rib structure connecting the outer wall spaced from the inner wall to define hollow portions therebetween;

four corner braces, each corner brace being adapted to be secured to the side panels to support the end panels, the base and the panels being of molded plastic construction, wherein each said panel includes a plurality of hollow internal wells in a checkerboard configuration defining integral ribs therebetween to reduce weight of the pallet bin while maintaining stiffness of the panels.

* * * * *